US009931540B1

(12) United States Patent
Lazar et al.

(10) Patent No.: US 9,931,540 B1
(45) Date of Patent: Apr. 3, 2018

(54) BALANCING EXERCISE DEVICES

(71) Applicant: Brunswick Corporation, Lake Forest, IL (US)

(72) Inventors: Cory H. Lazar, Chicago, IL (US); Gregory R. Highsmith, Libertyville, IL (US); Scott S. Dueball, Arlington Heights, IL (US)

(73) Assignee: Brunswick Corporation, Lake Forest, IL (US)

( * ) Notice: Subject to any disclaimer, the term of this patent is extended or adjusted under 35 U.S.C. 154(b) by 82 days.

(21) Appl. No.: 15/097,588

(22) Filed: Apr. 13, 2016

(51) Int. Cl.

| | |
|---|---|
| ***A63B 22/14*** | (2006.01) |
| ***A63B 26/00*** | (2006.01) |
| ***A63B 23/04*** | (2006.01) |
| ***A63B 22/16*** | (2006.01) |

(52) U.S. Cl.
CPC ..... *A63B 26/003* (2013.01); *A63B 22/16* (2013.01); *A63B 23/04* (2013.01)

(58) Field of Classification Search
CPC ... A63B 26/003; A63B 22/16; A63B 21/4047; A63B 22/0056; A63B 23/08–23/10; A63B 2026/006; A63B 21/023; A63B 21/04; A63B 21/0407; A63B 21/0421; A63B 21/045; A63B 21/0455
USPC ..... 482/79, 80, 146, 147
See application file for complete search history.

(56) References Cited

U.S. PATENT DOCUMENTS 2,253,996 A * 8/1941 Bechman ..... A63B 22/16 482/146
D178,996 S * 10/1956 Gordon ..... D6/354
3,416,792 A * 12/1968 Morgan ..... A63B 22/16 482/146
3,741,540 A * 6/1973 Shimizu ..... A63B 23/085 482/128
3,967,820 A * 7/1976 Harper ..... A63B 22/16 280/12.1
4,089,520 A * 5/1978 Ozbey ..... A63B 21/023 482/128
4,700,947 A * 10/1987 Heatwole ..... A63B 21/0004 482/146

(Continued)

FOREIGN PATENT DOCUMENTS

| | | |
|---|---|---|
| CA | 2206028 | 10/2006 |
| JP | 10-290845 | 11/1998 |

(Continued)

*Primary Examiner* — Gregory Winter
(74) *Attorney, Agent, or Firm* — Andrus Intellectual Property Law, LLP

(57) ABSTRACT

A balancing exercise device has a central balancing member having a center of balance. A first foot pad is coupled to the central balancing member on a first side of the center of balance. The first foot pad is pivotable with respect to the central balancing member. A second foot pad is coupled to the central balancing member on an opposite, second side of the center of balance. The second foot pad is pivotable with respect to the central balancing member. An application of equal forces on the first and second foot pads balances the central balancing member with respect to the center of balance. An application of unequal forces on the first and second foot pads causes the central balancing member to pivot about the center of balance until one of the first and second foot pads engages with a support surface on which the central balancing member is supported.

9 Claims, 3 Drawing Sheets

(56) References Cited

U.S. PATENT DOCUMENTS

| | | | | |
|---|---|---|---|---|
| 4,822,039 | A * | 4/1989 | Gonzales | A63B 22/16 482/128 |
| 4,911,440 | A * | 3/1990 | Hyman | A63B 22/16 482/146 |
| 5,092,586 | A | 3/1992 | Tuthill et al. | |
| 5,496,248 | A | 3/1996 | Batscher | |
| 5,643,154 | A | 7/1997 | Awbrey et al. | |
| 5,755,651 | A * | 5/1998 | Homyonfer | A63B 22/16 482/123 |
| 5,839,737 | A * | 11/1998 | Kruczek | A63C 17/0033 280/11.115 |
| 6,306,068 | B1 * | 10/2001 | Heatwole | A63B 21/0004 482/146 |
| 6,652,432 | B2 | 11/2003 | Smith | |
| 6,705,977 | B1 * | 3/2004 | Ziak | A63B 21/0004 472/135 |
| 7,537,555 | B2 * | 5/2009 | Soletski | A63B 22/16 482/142 |
| 7,806,807 | B2 | 10/2010 | Genua | |
| 7,811,217 | B2 | 10/2010 | Odien | |
| 8,360,943 | B2 * | 1/2013 | Smith | A63B 21/0004 482/146 |
| 8,678,985 | B2 | 3/2014 | Mattox | |
| 9,095,738 | B2 | 8/2015 | Senegal | |
| 9,220,944 | B2 | 12/2015 | Moscarello | |
| 2008/0020856 | A1 * | 1/2008 | Rosa | A63B 26/003 473/269 |
| 2013/0316885 | A1 * | 11/2013 | Harwin | A63B 26/003 482/142 |
| 2015/0018178 | A1 | 1/2015 | Carbone et al. | |
| 2015/0251056 | A1 | 9/2015 | Crist | |
| 2016/0175654 | A1 * | 6/2016 | Harwin | A63B 26/003 482/142 |

FOREIGN PATENT DOCUMENTS

| | | |
|---|---|---|
| KR | 10-2014-0080938 | 7/2014 |
| WO | 86/04250 | 7/1986 |
| WO | 2010/063870 | 6/2010 |

* cited by examiner

BALANCING EXERCISE DEVICES

FIELD

The present disclosure relates to exercise devices for personal exercise.

BACKGROUND

U.S. Patent Application Publication No. 2015/0018178 discloses an exercise balance board having a platform for a user. The platform is supported by a resilient air-filled partial sphere. The balance board allows a user to exercise upper and lower muscle extremity groups either individually or simultaneously.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

A balancing exercise device comprises a central balancing member having a center of balance. A first foot pad is coupled to the central balancing member on a first side of the center of balance. The first foot pad is pivotable with respect to the central balancing member. A second foot pad is coupled to the central balancing member on an opposite, second side of the center of balance. The second foot pad is pivotable with respect to the central balancing member. An application of equal downward forces on the first and second foot pads balances the central balancing member with respect to the center of balance. An application of unequal downward forces on the first and second foot pads causes the central balancing member to pivot about the center of balance until one of the first and second foot pads engages with a support surface on which the central balancing member is supported.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

Figure 1:
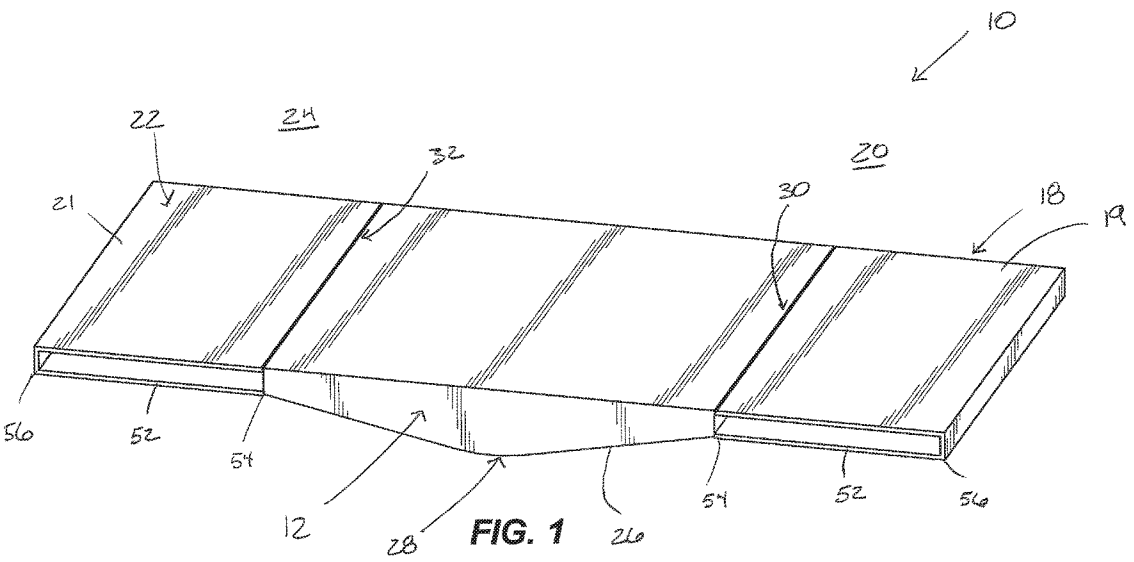
FIG. 1 is a perspective view of a balancing exercise device according to the present disclosure.
Figure 2:
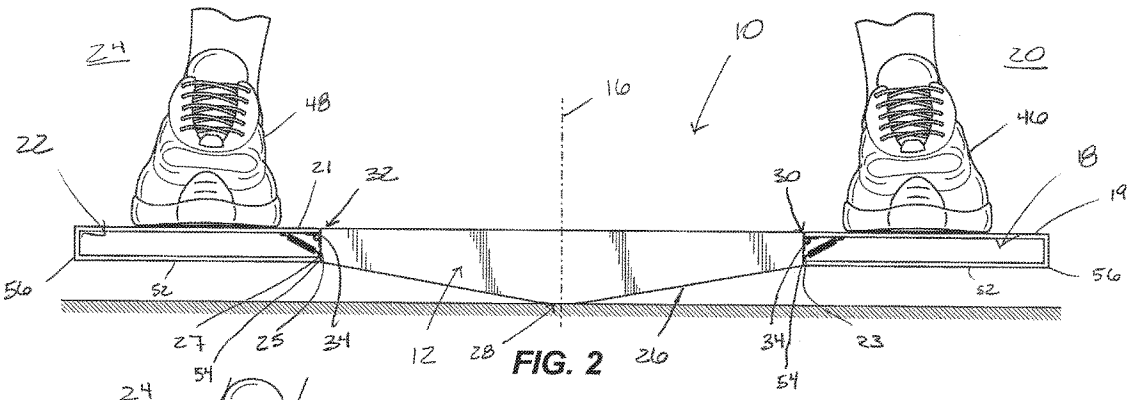
FIG. 2 is an elevation view showing an application of equal downward forces being placed on first and second foot pads of the balancing exercise device.
Figure 3:
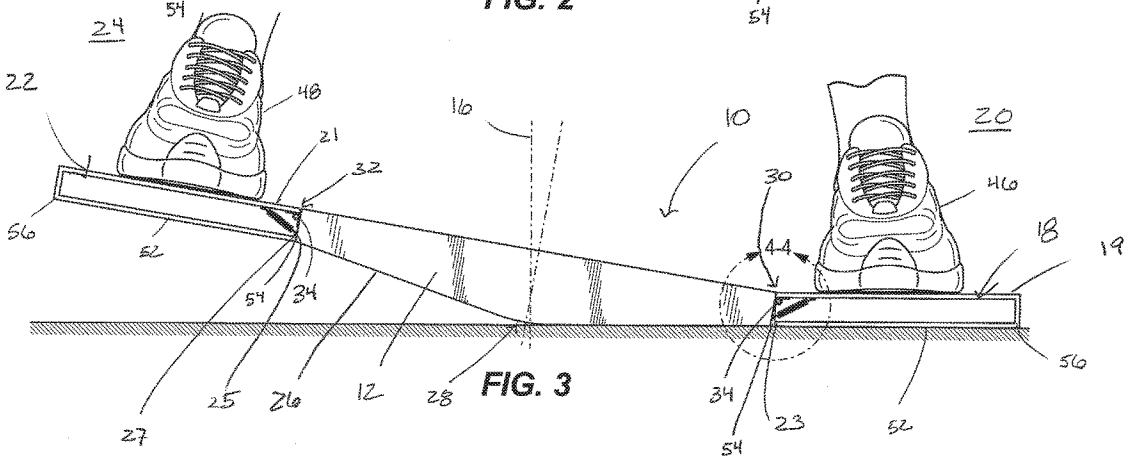
FIG. 3 is an elevation view showing an application of unequal downward forces being placed on the first and second foot pads.

FIGS. 1-3 depicts a balancing exercise device 10 according to the present disclosure. The balancing exercise device 10 has a central balancing member 12 that is capable of being balanced with respect to a support surface 14 about a center of balance 16. A first foot pad 18 is coupled to the central balancing member 12 on a first side 20 of the center of balance 16. A second foot pad 22 is coupled to the central balancing member 12 on an opposite, second side 24 of the center of balance 16. As will be discussed further herein below, the first and second foot pads 18, 22 have planar top surfaces 19, 21 and are configured to support a user's feet 46, 48 (see FIGS. 2 and 3) as the user stands on the planar top surfaces 19, 21 and adjusts his or her weight back and forth on his or her feet 46, 48. Adjustment of the user's weight back and forth on his or her feet 46, 48 balances the balancing exercise device 10 with respect to the center of balance 16 and/or rocks the balancing exercise device 10 back and forth about the center of balance 16. By balancing and/or rocking the balancing exercise device 10 back and forth, the user exercises both upper and lower extremity groups, either individually or simultaneously.

The central balancing member 12 has a bottom surface 26 that is configured to abut the support surface 14. The bottom surface 26 has a centrally located contact location 28 about which the center of balance 16 is defined. The shape and configuration of the central balancing member 12 can be different than what is illustrated. In the illustrated example, the contact location 28 is formed by an apex of the bottom surface 26 of the central balancing member 12. The central balancing member 12 is pivotable about the apex. In the illustrated example, the central balancing member 12 has a vertical cross-section that is triangular in shape.

A first pivot joint 30 connects the first foot pad 18 to the central balancing member 12 such that the first foot pad 18 is pivotable with respect to the central balancing member 12. A second pivot joint 32 connects the second foot pad 22 to the central balancing member 12 such that the second foot pad 22 is pivotable with respect to the central balancing member 12. The first and second pivot joints 30, 32 are configured such that the first and second foot pads 18, 22 are pivotable into and between a first position (see FIG. 2) wherein the first and second foot pads 18, 22 have top surfaces that are in parallel alignment with each other, and a second position (see FIG. 3) wherein the top surfaces of first and second foot pads 18, 22 are out of parallel alignment which each other. The first and second pivot joints 30, 32 are configured such that the first and second foot pads 18, 22 are pivotable out of the first position shown in FIG. 2 in only one direction. In other words, the configuration of the first and second pivot joints 30, 32 prevents pivoting motion of the first and second foot pads 18, 22 past parallel with each other (i.e. past the position shown in FIG. 2). The type and configuration of the first and second pivot joints 30, 32 can vary. In the illustrated example, the first and second pivot joints 30, 32 include hinges 34, 36. In the illustrated example, location of the first and second pivot joints 30, 32 at the top edges of the first and second foot pads 18, 22 prevents pivoting motion past parallel. That is, pivoting movement past parallel is prevented by engagement between the respective side surfaces 23, 25 of the first and second foot pads 18, 22 and the side surfaces 27, 29 of the central balancing member 12.

The configuration of the first and second foot pads 18, 22 and the central balancing member 12 can vary from that which is shown. In the illustrated example, the first and second foot pads 18, 22 have planar top surfaces 19, 21 that are in parallel alignment which each other when the balancing exercise device 10 is in the position shown in FIG. 2. The planar top surfaces 19, 21 are out of parallel alignment with each other when the balancing exercise device 10 is in the position shown in FIG. 3.

Figure 4:
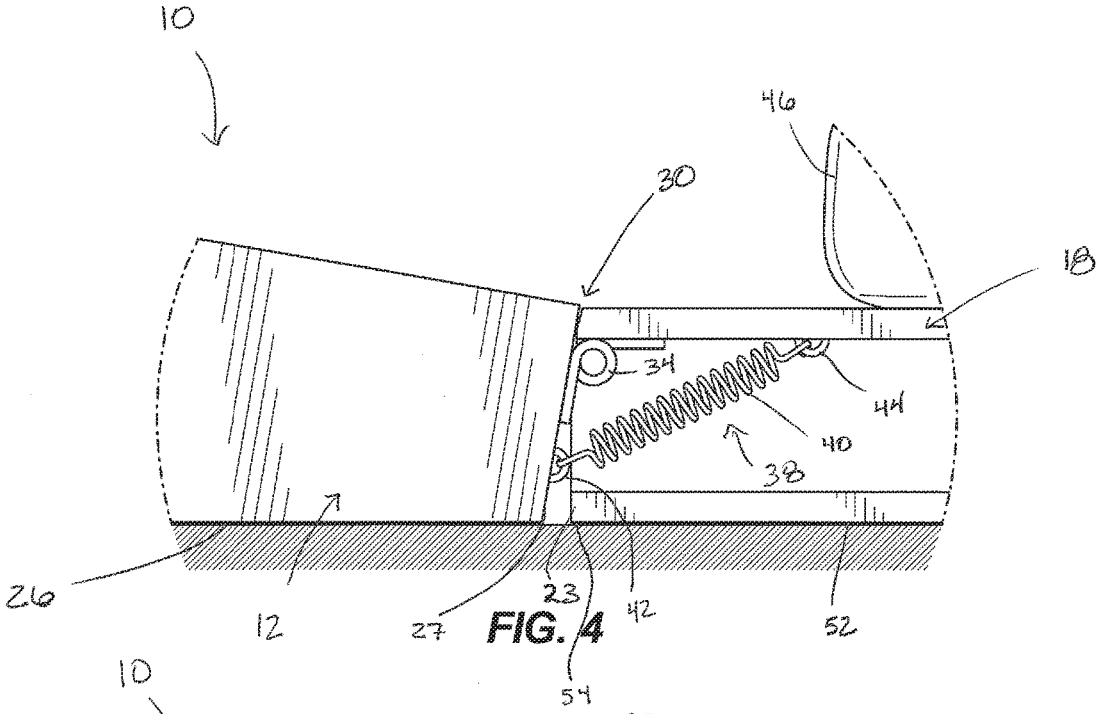
FIG. 4 is a view of section 4-4 taken in FIG. 3 showing one example of a pivot joint and resilient member for coupling the food pads to the balancing exercise device.
Figure 5:
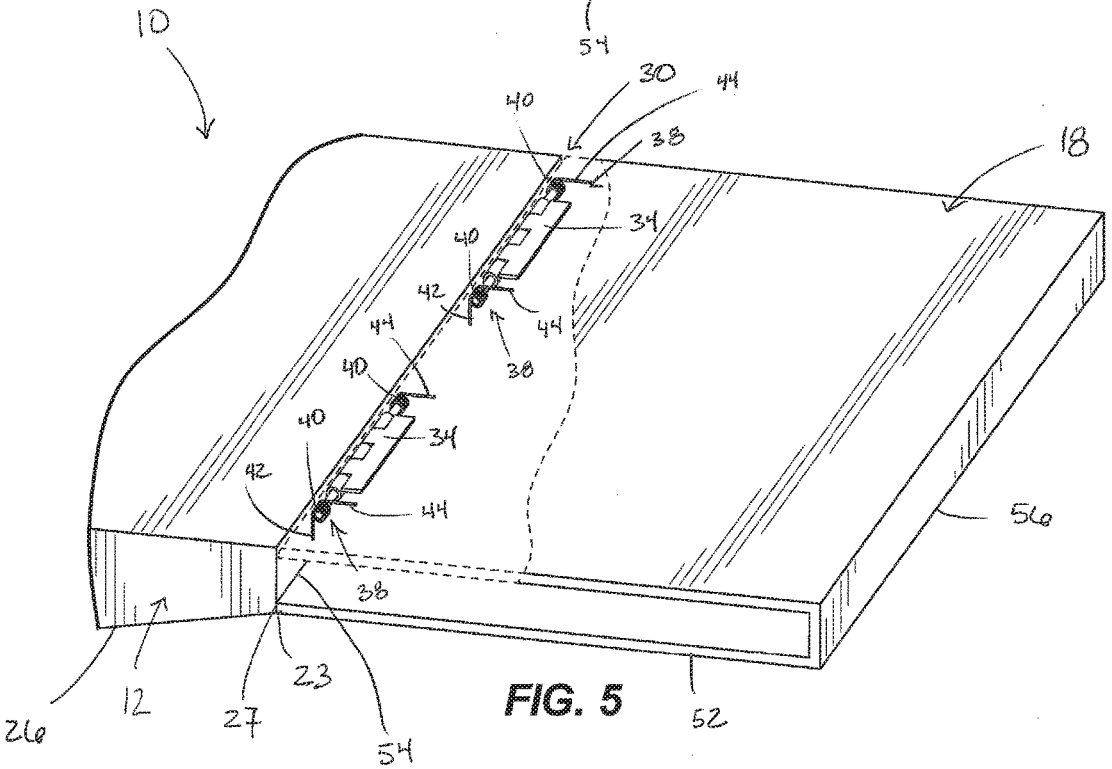
FIG. 5 is a view of an alternate example a pivot joint and resilient member for coupling the food pads to the balancing exercise device.

Referring to FIGS. 4 and 5, resilient members 38 span the coupling between the first and second foot pads 18, 22 and the central balancing member 12. The resilient members 38 are configured to bias (i.e. pull or push) the first and second foot pads 18, 22 towards the first position shown in FIG. 2. The configuration of the resilient members 38 can vary from that which is shown. FIG. 4 shows one example wherein the first and second resilient members 38 are tension springs having a first end 42 connected to the central balancing member 12 and a second end 44 connected to the central balancing member 12. In this example, the spring 40 tends to pull the respective foot pad 18, 22 towards the position wherein the top surfaces of the respective foot pads 18, 22 are in parallel alignment with each other (and in this example also with the top surface of the central balancing member 12). FIG. 5 depicts an alternate example wherein the springs 40 are torsion springs having first and second ends 42, 44 connected to the respective foot pad and central balancing member 12. Again, the springs 40 tend to pull the respective foot pad 18, 22 towards the position shown in FIG. 5.

The present disclosure thus provides a balancing exercise device 10 that is configured so that an application of equal downward forces by the user's feet 46, 48 on the first and second foot pads 18, 22 balances the central balancing member 12 with respect to the center of balance 16. As shown in FIG. 3, an application of unequal downward forces on the first and second foot pads 18, 22 causes the central balancing member 12 to pivot about the center of balance 16 (towards the side of the greater force) until the respective foot pad 18, 22 on the side of the greater force engages with the support surface 14. In the illustrated example, a relatively larger force is being applied on the first foot pad 18 than the second foot pad 22.

Each of the first and second foot pads 18, 22 have bottom surfaces 52 with inner and outer edges 54, 56. As the central balancing member 12 pivots about the center of balance 16, the outer edge 56 of the respective foot pad 18, 22 initially engages the support surface 14 before the inner edge 54 of the respective foot pad 18, 22.

Continued unequal application of the unequal downward forces ultimately results in engagement of the inner edge 54 of the bottom surface 52 with the support surface 14, such that continued pivoting of the central balancing member 12 about the center of balance 16 is prevented. Initial engagement of the outer edge 56 with the support surface 14 causes a pivoting motion to occur between the central balancing member 12 and the first foot pad 18. More specifically, when the outer edge 56 engages the support surface 14, the central balancing member 12 continues to pivot about the center of balance 16, while the first foot pad 18 begins to pivot about its outer edge 56. As this pivoting motion occurs, the second foot pad 22 is configured to remain in place (in the illustrated example it remains parallel with the top surface of the central balancing member 12).

These same pivoting movements occur when a relatively larger force is applied by the user's foot on the second food pad 22 rather than the first foot pad 18.

Through research and experimentation, the present inventors have endeavored to provide a balancing exercise device that allow a user to ergonomically shift their weight from one foot to the other, without requiring excessive balancing action, thus allowing the balancing exercise device to be used for extended periods of time. The inventors found that prior art rocking or balance boards lack suitable ergonomics, particularly with respect to the feet and ankles of the user. Advantageously, the balancing exercise devices 10 herein described promote better ergonomics while allowing the user to safely shift their weight to one side. As each respective foot pad contacts the support surface, it begins to rotate through a degree of motion with respect to the outer edge 56. In certain non-limiting examples, this degree of motion can be 10 degrees. This allows the respective foot pad to become nearly flat with the support surface 14 when the balancing exercise device 10 is in the position shown in FIG. 3. The resilient members 38 advantageously facilitate these movements and also provide a damper as the bottom of movement (i.e. the position shown in FIG. 3) is approached. This provides some assistance and/or rebound when the user shifts their weight back to the opposite side. This arrangement thus advantageously creates a smooth transition, limits uncomfortable impact, and minimizes balancing requirements of the user.

The dimensions of the balancing exercise device 10 can vary. In certain examples, the bottom edge of the central balancing member 12 has a radius of at least 4 inches and the vertical displacement of the user's feet when one is up and the other is down can be about 2.5 inches.

In the present description, certain terms have been used for brevity, clarity and understanding. No unnecessary limitations are to be inferred therefrom beyond the requirement of the prior art because such terms are used for descriptive purposes only and are intended to be broadly construed.

What is claimed is:

1. A balancing exercise device comprising:

a central balancing member having a center of balance;

a first foot pad that is coupled to the central balancing member on a first side of the center of balance, wherein the first foot pad is pivotable with respect to the central balancing member; and a second foot pad that is coupled to the central balancing member on an opposite, second side of the center of balance, wherein the second foot pad is pivotable with respect to the central balancing member;

wherein the central balancing member and first and second foot pads are configured such that an application of equal downward forces on the first and second foot pads balances the central balancing member with respect to the center of balance;

wherein an application of unequal downward forces on the first and second foot pads causes the central balancing member to pivot about the center of balance until one of the first and second foot pads engages with a support surface on which the central balancing member is supported;

wherein engagement of the one of the first and second foot pads with the support surface causes a pivoting motion to occur between the one of the first and second foot pads and the central balancing member;

wherein each of the first and second foot pads have bottom surfaces with inner and outer edges, and wherein as the central balancing member pivots about the center of balance, the outer edge of the one of the first and second foot pads engages the support surface before the inner edge of the one of the first and second foot pads such that the one of the first and second food pad pivots with respect to the outer edge of the one of the first and second foot pads as the central balancing member continues to pivot about the center of balance; and wherein continued application of unequal downward forces causes engagement of the inner edge of the one of the first and second foot pads with the support surface, which prevents continued pivoting of the central balancing member about the center of balance.

2. The balancing device according to claim 1, wherein during the pivoting motion, the other of the first and second foot pads is configured to remain in place.

3. A balancing exercise device comprising:

a central balancing member having a center of balance;

a first foot pad that is coupled to the central balancing member on a first side of the center of balance, wherein the first foot pad is pivotable with respect to the central balancing member; and a second foot pad that is coupled to the central balancing member on an opposite, second side of the center of balance, wherein the second foot pad is pivotable with respect to the central balancing member;

wherein the central balancing member and first and second foot pads are configured such that an application of equal downward forces on the first and second foot pads balances the central balancing member with respect to the center of balance;

wherein an application of unequal downward forces on the first and second foot pads causes the central balancing member to pivot about the center of balance until one of the first and second foot pads engages with a support surface on which the central balancing member is supported;

wherein engagement of the one of the first and second foot pads with the support surface causes a pivoting motion to occur between the one of the first and second foot pads and the central balancing member;

wherein the central balancing member has a bottom surface that is configured to abut the support surface, the bottom surface having a contact location about which the center of balance is defined;

a first pivot joint that pivotably connects the first foot pad to the central balancing member and a second pivot joint that pivotably connects the second foot pad to the central balancing member;

wherein the first and second pivot joints are configured such that the first and second foot pads are pivotable into and between a first position wherein the first and second foot pads are in parallel alignment with each other and a second position wherein the first and second foot pads are out of parallel alignment with each other; and first and second resilient members that tend to bias the first and second foot pads towards the first position when the first and second foot pads are in the second position, respectively.

4. The balancing exercise device according to claim 3, wherein the first and second pivot joints each comprise hinges.

5. The balancing exercise device according to claim 3, wherein each of the first and second foot pads are pivotable out of the first position in only one direction.

6. The balancing exercise device according to claim 3, wherein the first and second resilient members each comprise springs.

7. The balancing exercise device according to claim 6, wherein each of the springs comprise at least one of a torsion spring and a tension spring.

8. A balancing exercise device comprising:

a central balancing member having a center of balance;

a first foot pad that is coupled to the central balancing member on a first side of the center of balance, wherein the first foot pad is pivotable with respect to the central balancing member;

a second foot pad that is coupled to the central balancing member on an opposite, second side of the center of balance, wherein the second foot pad is pivotable with respect to the central balancing member;

wherein the central balancing member and first and second foot pads are configured such that an application of equal downward forces on the first and second foot pads balances the central balancing member with respect to the center of balance;

wherein the first and second foot pads have planar top surfaces and wherein the first and second foot pads are pivotable into and between a first position wherein the planar top surfaces are in parallel alignment to each other and a second position wherein the planar top surfaces are out of parallel alignment with each other;

a first pivot joint that pivotably connects the first foot pad to the central balancing member and a second pivot joint that pivotably connects the second foot pad to the central balancing member; wherein the first and second pivot joints are configured such that the first and second foot pads are pivotable into and between the first position wherein the first and second foot pads are in parallel alignment with each other and the second position wherein the first and second foot pads are out of parallel alignment with each other; and first and second resilient members that tend to bias the first and second foot pads towards the first position when the first and second foot pads are in the second position, respectively.

9. The balancing exercise device according to claim 8, wherein each of the first and second foot pads are pivotable out of the first position in only one direction.

* * * * *